United States Patent [19]

Roy

[11] 4,149,323

[45] Apr. 17, 1979

[54] FOOTWEAR UPPER CONSTRUCTION

[76] Inventor: Norman A. Roy, Waterville Hill Rd., Norridgewock, Me. 04957

[21] Appl. No.: 849,347

[22] Filed: Nov. 7, 1977

[51] Int. Cl.[2] ..... A43B 23/00; A43B 23/06; A43B 23/26

[52] U.S. Cl. ..... 36/48; 36/54

[58] Field of Search ..... 36/48, 47, 45, 49, 54

[56] References Cited

U.S. PATENT DOCUMENTS

| | | | |
|---|---|---|---|
| 1,578,345 | 3/1926 | Nelson | 36/48 X |
| 1,836,926 | 12/1931 | Levotch | 36/47 |
| 1,839,274 | 1/1932 | Sundean | 36/48 X |
| 2,897,610 | 8/1959 | Campagna | 36/54 X |
| 2,915,835 | 12/1959 | Snitzer | 36/45 |

FOREIGN PATENT DOCUMENTS

| | | | |
|---|---|---|---|
| 433711 | 9/1926 | Fed. Rep. of Germany | 36/45 |

*Primary Examiner*—James Kee Chi

*Attorney, Agent, or Firm*—Shoemaker and Mattare, Ltd.

[57] ABSTRACT

There is provided a footwear upper construction which includes a toe panel which defines a toe portion and two rearwardly extending side portions, and two ankle panels adapted to be stitched to the inner margins of the rearwardly extending side portions. The toe panel defines slots at the forward inner edges of the side portions, and each ankle panel defines a vertical slot adjacent the toe end of the same. These slots are interlaced or interleaved with each other prior to the stitching and the water-proofing which may be applied in the case of boots. The interleaving of the two slots reduces the risk of pin-hole leakage at the forward end of the connection between the ankle panel and the toe panel.

3 Claims, 7 Drawing Figures

FOOTWEAR UPPER CONSTRUCTION

This invention relates generally to a method of manufacturing an article of footwear, and the article so manufactured.

In many items of footwear, particularly men's boots intended for rugged use in the bush, on constructional sites, and the like, there is a need to provide a construction which is absolutely waterproof and which will not lose its waterproof characteristics despite long-term use.

In the manufacture of men's work boots, it is essential that the boot be assembled from individual separate panels of leather, which are stitched together and waterproofed with a suitable compound applied to the joint region. Because of the typical shape of a foot, particularly at the instep, a commonly used panel configuration includes a toe panel which has a forwardly projecting, rounded toe portion and two rearwardly extending side portions which are spaced apart, together with two ankle panels extending up from the side portions of the toe panel. A tongue portion extends rearwardly between the side edges of the toe panel and is integral therewith, and the ankle portions are typically inserted edgewise into slots defined between the tongue portion and the side portions of the toe panel. The joint thus resembles that between two sheets of paper, of which one has a partial cut or slot extending perpendicularly in from one edge, with the other sheet of paper inserted edgewise into the slot and then rotated about the slot to lie in flat juxtaposition with the first sheet. Thus, the inserted sheet on one side of the slot lies above the slotted sheet, and on the other side of the slot lies below the slotted sheet.

The problem with a construction of this kind is related to the "pinpoint" hole at the terminal end of the slot, particularly if the inserted sheet does not, for some reason, extend all the way to the end. If this should happen, particularly in view of the finite thickness of the leather panels, the terminal end of the slot opens up and provides a location of weakness in terms of waterproofing, which could develop into a definite location of leakage.

It is an aim of the present invention to overcome this problem of pinpoint leakage in a boot construction with overlapping and stitched panels, and in particular to avoid the problem arising when the inserted panel does not reach to the end of the slot in the slotted panel.

Accordingly, this invention provides a footwear upper construction comprising:

a toe panel having a toe portion and two rearwardly extending side portions, the inner edges of the side portions being spaced apart and terminating at spaced apart locations, and a tongue portion extending rearwardly from the toe portion between said side edges, the tongue portion being defined by terminal parts of said side edges and a rearward margin extending between said side edges, two ankle panels each being defined in part by a lower edge and a forward edge, the forward edge terminating short of the lower edge, the lower edge extending in spaced relationship forwardly beyond the forward ege, then curving upwardly and rearwardly to terminate on said forward edge at a point spaced from the termination of the forward edge, thereby to define an upwardly extending tab forwardly adjacent said forward edge, each ankle panel being positioned with its tab interlocking with the forward region of one of the inner edges of said toe panel, so that the forward termination of each inner edge substantially coincides with the termination of the forward edge of one of the ankle panels, the lower edge and the tab of each ankle panel being located to the inside of the toe panel, each ankle panel being stitched along its lower edge to the toe panel, the overlapping and stitched parts of the toe panel and the ankle panels being waterproofed by the application of a waterproofing compound.

One embodiment of this invention is illustrated in the accompanying drawings, in which like numerals denote like parts throughout the several views, and in which.

Figure 2:
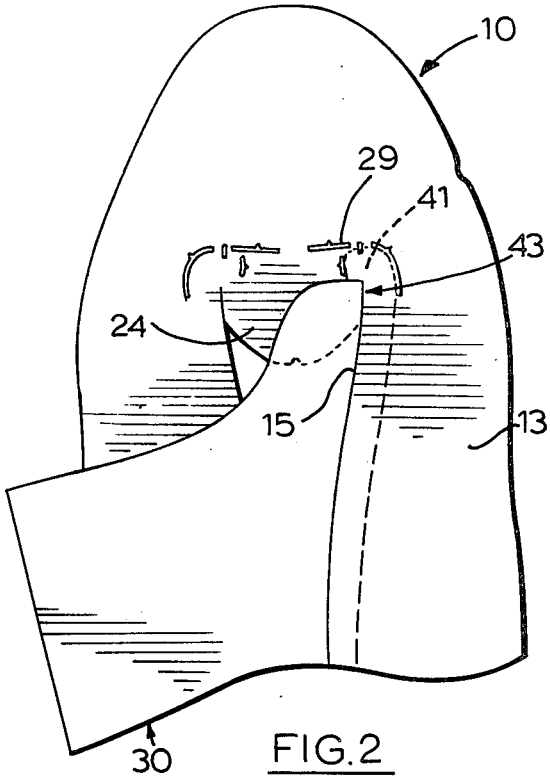
FIG. 2 is a plan view of the toe portion with an ankle portion inserted into place, prior to stitching.
Figure 3:
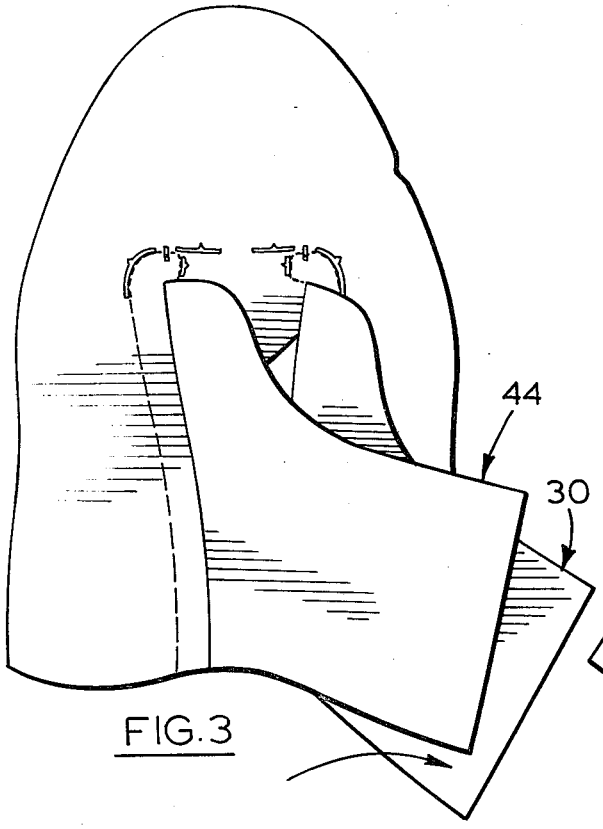
Figure 4:
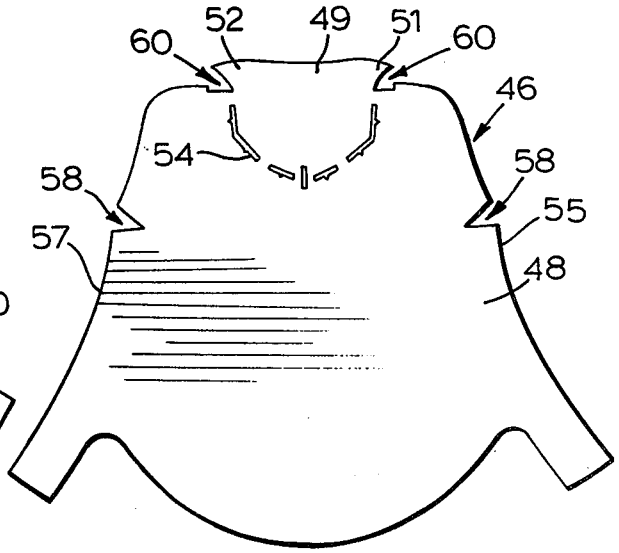
Figure 5:
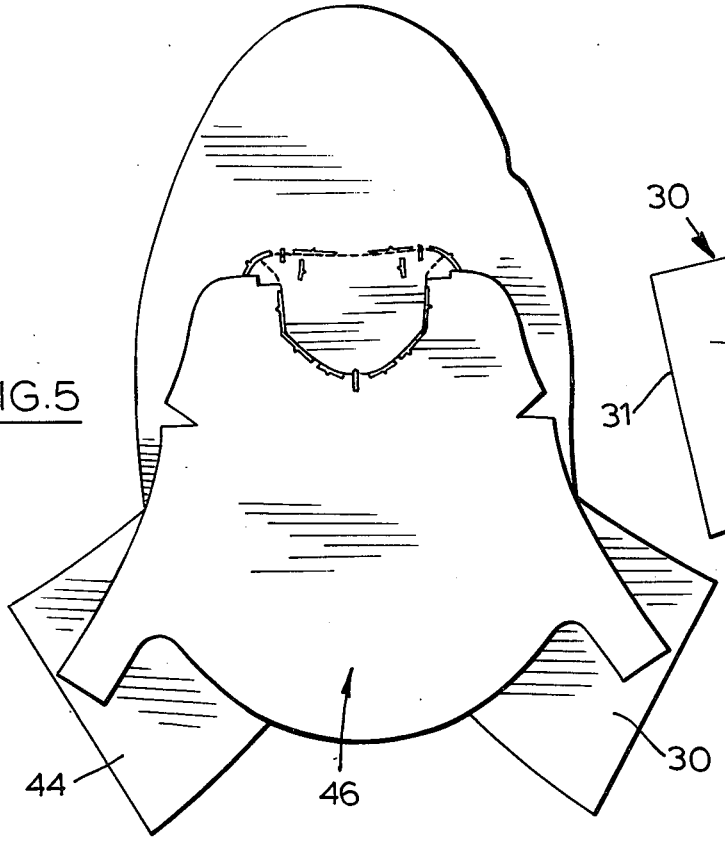
Figure 2A:
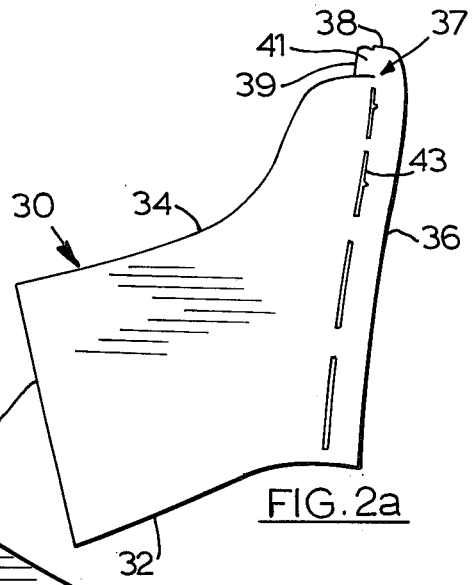
Figure 6:
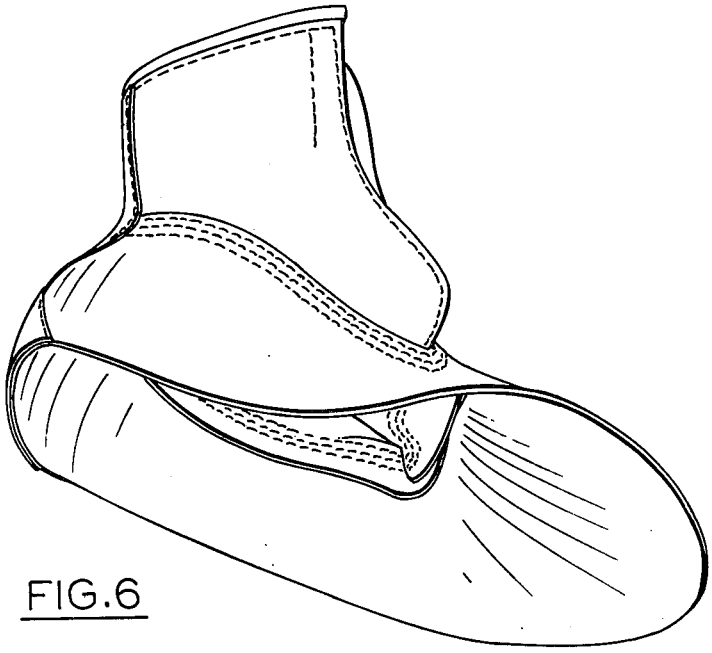

FIG. 2A, on the second drawing sheet, shows the ankle panel by itself;

FIG. 3 shows both of the ankle panels inserted into place in the toe panel;

FIG. 4 shows a tongue panel in plan view;

FIG. 5 shows the tongue panel of FIG. 4 laid in place against the panels of FIG. 3; and FIG. 6 is a perspective view of an assembled and stitched upper constructed in accordance with this invention.

Figure 1:
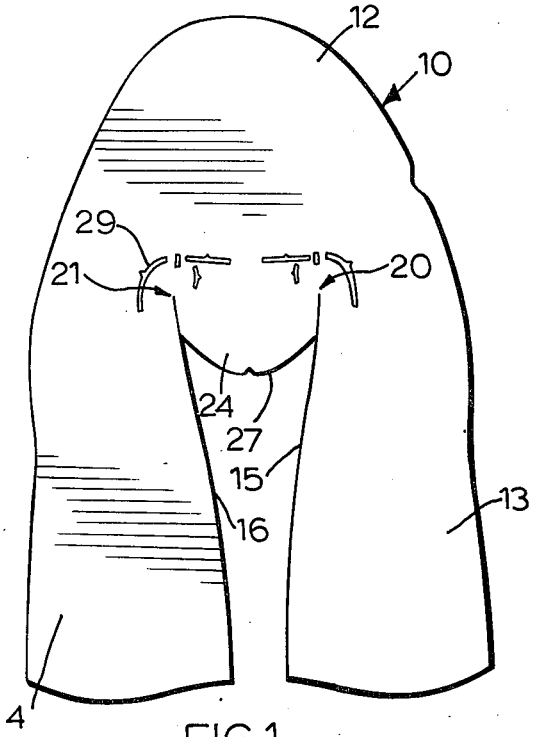
FIG. 1 is a plan view of a toe portion of an upper.

Attention is first directed to FIG. 1 which shows a toe panel 10 for use in a footwear upper construction, the panel 10 having a toe portion 12 and two rearwardly extending side portions 13 and 14. The inner edges 15 and 16 of the side portions 13 and 14 respectively are spaced apart as can be seen, and terminate at spaced apart locations 20 and 21. A tongue portion 24 extends rearwardly from the toe portion 12 between the inner edges 15 and 16, the tongue portion being defined by terminal parts of the inner edges 15 and 16 and a rearward margin 27 extending between the inner edges 15 and 16.

Markings 29 are applied with ink or the like to the underside of the toe panel to allow proper alignment of subsequent panels prior to stitching. The markings 29 have been shown in FIG. 1 for clarity, even though they are on the underside.

Attention is now directed to FIG. 2A, which shows an ankle panel 30 which is defined by an upper edge 31, a rearward edge 32, a forward edge 34 and a lower edge 36. As can be seen in FIG. 2A, the forward edge 34 terminates short of the lower edge 36, at a location identified by the numeral 37, and the lower edge extends in spaced relationship forwardly beyond the forward edge 34 and below the location 37, then curves upwardly at 38 and finally extends rearwardly at 39 to terminate on the forward edge 34. There is thus defined an upwardly extending tab 41 which is located forwardly adjacent the forward edge 34 at its lowermost region.

Markings 43 are provided on the surface shown to allow those responsible for stitching to align the panels together prior to the stitching operation.

There are two such ankle panels provided, and FIG. 2 shows how one of these is interlocked with the toe panel 10 at the forward end of the rightward inner edge 15. All of the views of the toe panel 10, except for that in FIG. 6, are plan views looking upon the toe panel 10 from above so that the outside surface is seen. The markings 29 are placed on the underside of the toe panel 10, as has previously been described, but are made visible in the figures for the sake of clarity. It will be seen that the ankle panel 30 in FIG. 2 is set into the slot 43 defined at the forward end of the inner edge 15 between the side portion 13 and the tongue portion 24. The lower marginal edge of the ankle panel 30 along the lower edge 36 thereof lies inside or under the side portion 13, and the tab 41 also lies to the inside of the toe panel 10. Since the markings 29 are on the underside or inside of the toe panel 10, it is a simple matter for the person responsible for the stitching to align the ankle panel 30 into the position shown in FIG. 2 prior to the stitching operation.

It will thus be appreciated that a double-slotted fit has been provided at the forward end of the ankle panel 30. The ankle panel 30 has itself been inserted into the slot between the tongue portion 24 and the side portion 13, whereas the tongue portion 24 has likewise been inserted into the slot between the tab 41 and the remainder of the ankle panel 30. This means that it is not possible to widen out a pin-hole aperture in either of these slots. For example, if the ankle panel 30 were not placed all the way to the forward end of the slot between the tongue portion 24 and the side portion 13, the tab 41 would cover across the remaining gap in the slot between the tongue portion 24 and the side portion 13, and would not permit this gap to become a location of leakage.

In the preferred method of construction, however, the ankle panel 30 is inserted with respect to the toe panel 10 such that the forward termination of the inner edge 15 substantially coincides with the termination of the forward edge 34 of the ankle panel 30.

FIG. 3 shows the first ankle panel 30 in a condition in which it has been folded over to the right so as not to interfere with a second ankle panel 44 which is identical to the panel 30 except that its handedness is reversed. In other words, the ankle panels 30 and 44 have substantially identical configurations, but in the one case the "outside" surface is on one face whereas in the other the outside surface is on the other face.

After the two ankle panels 30 and 44 have been inserted and stitched into place, a tongue panel 46 as seen in FIG. 4 is provided and stitched into place. The tongue panel 46 is generally bi-laterally symmetrical and has a main portion 48 intended to provide the tongue of the boot, the tongue being stitched into place at both of its sides, and a forwardly extending portion 49 which includes sideward tabs 51 and 52. The tongue panel 48 also includes markings 54 which are located on the actual surface seen in FIG. 4, for the purpose of allowing alignment between the tongue panel 46 and the other panels of the upper. The rightward side edge 55 of the tongue panel 46 is intended to be aligned with the forward edge of the ankle panel 30, whereas the other side edge 57 of the tongue panel 46 is intended to be aligned with the forward edge of the other ankle panel 44. The notches 58 provided in the side edges 55 and 57 are intended to be closed up when stitched to the ankle panels.

The tongue panel 46 is arranged so that the tongue portion 24 of the toe panel 10 lies to the outside of the tongue panel and comes into alignment with the markings 54, and such that the sideward tabs 51 and 52 lie to the inside of the upwardly extending tabs 41 of the ankle panels 30 and 44.

In FIG. 5 this situation is illustrated, from which it will be appreciated that the inner corners 60 defining the sides of the outward tabs 51 and 52 lie in close coincidence with the location at which the slot of an ankle panel crosses one of the slots of the toe panel.

Subsequent to the arrangement of the various panels as seen in FIG. 5 the stitching of the tongue panel 46 takes place. Although FIG. 5 shows no stitching of any of the panels, it will be understood that the ankle panels are actually stitched to the tongue panel 46 along the forward edge 34 before the tongue panel 46 is positioned, otherwise it would not be possible to maintain the panels in the proper orientation for handling. FIG. 5 has omitted the stitching of the ankle panels for the sake of clarity.

Subsequent to the stitching operation the upper will resemble that shown in FIG. 6, and at this stage a suitable waterproofing is applied against all overlapped joints between the various panels. A suitable waterproofing would comprise a layer of latex and a layer of silicone base paste.

I claim:

1. A footwear upper construction comprising:

a toe panel having a toe portion and two rearwardly extending side portions, the inner edges of the side portions being spaced apart and terminating at spaced apart locations, and a tongue portion extending rearwardly from the toe portion between said side edges, the tongue portion being defined by terminal parts of said side edges and a rearward margin extending between said side edges, two ankle panels each being defined in part by a lower edge and a forward edge, the forward edge terminating short of the lower edge, the lower edge extending in spaced relationship forwardly beyond the forward edge, then curving upwardly and rearwardly to terminate on said forward edge at a point spaced from the termination of the forward edge, thereby to define an upwardly extending tab forwardly adjacent said forward edge, each ankle panel being positioned with its tab interlocking with the forward region of one of the inner edges of said toe panel, so that the forward termination of each inner edge substantially coincides with the termination of the forward edge of one of the ankle panels, the lower edge and the tab of each ankle panel being located to the inside of the toe panel, each ankle panel being stitched along its lower edge to the toe panel, the overlapping and stitched parts of the toe panel and the ankle panels being waterproofed.

2. The invention claimed in claim 1, in which the footwear upper further comprises a tongue panel having a forwardly extending portion lying to the inside of said toe panel, said forwardly extending portion having sideward tabs lying to the inside of said upwardly extending tabs of the ankle panels, the said tongue portion of the toe panel lying to the outside of the tongue panel.

3. The invention claimed in claim 1, in which the waterproofing comprises a layer of latex and a layer of silicone base paste.

* * * * *